US005190436A

United States Patent [19]

Sorlie

[11] Patent Number: 5,190,436

[45] Date of Patent: Mar. 2, 1993

[54] CARRIAGE ASSEMBLY HAVING SIDE SHIFTABLE AND ADJUSTABLE FORKS

[75] Inventor: Kjell Sorlie, Tonsberg, Norway

[73] Assignee: Caterpillar Industrial Inc., Mentor, Ohio

[21] Appl. No.: 710,850

[22] Filed: Jun. 6, 1991

[51] Int. Cl.[5] ..... B66F 9/14

[52] U.S. Cl. ..... 414/667; 414/671

[58] Field of Search ..... 414/664, 665, 666, 667, 414/668, 669, 670, 671, 621

[56] References Cited

U.S. PATENT DOCUMENTS

| | | | |
|---|---|---|---|
| 3,092,274 | 6/1963 | Harris | 214/620 |
| 3,512,671 | 5/1970 | Morocco . | |
| 3,754,673 | 8/1973 | Barda et al. . | |
| 3,819,078 | 6/1974 | Walsh . | |
| 3,831,795 | 8/1974 | Kawanshi et al. | 414/667 |
| 4,124,104 | 11/1978 | Yarris | 187/95 |
| 4,392,773 | 7/1983 | Johannson | 414/667 |
| 4,406,575 | 9/1983 | Gaibler | 414/667 |
| 4,902,190 | 2/1990 | House | 414/667 |
| 5,052,882 | 10/1991 | Blau et al. | 414/667 |
| 5,088,880 | 2/1992 | Field, Jr. | 414/667 |
| 5,096,363 | 3/1992 | Weinert et al. | 414/667 |
| 5,139,385 | 8/1992 | Chase et al. | 414/667 |

FOREIGN PATENT DOCUMENTS

| | | | |
|---|---|---|---|
| 3400916A1 | 7/1985 | Fed. Rep. of Germany . | |
| 3515524 | 11/1986 | Fed. Rep. of Germany | 414/671 |
| 2322085 | 3/1977 | France . | |
| 52-1850 | 1/1977 | Japan | 414/671 |
| 2234487 | 2/1991 | United Kingdom | 414/667 |

*Primary Examiner*—Michael S. Huppert
*Assistant Examiner*—Scott L. Lowe
*Attorney, Agent, or Firm*—Alan J. Hickman

[57] ABSTRACT

A carriage assembly has a frame and a carrier movably connected to the frame. First and a second forks are slidably mounted on the frame and movable in transverse directions along the frame. First and a second jacks are connected to and between the first and second forks, respectively, and the carrier. A third jack is connected to and between the carrier and the frame. The carrier and jacks are disposed between a surface of the carriage frame and a rear surface of the forks. The first and second jacks are selectively actuatable to independently move the forks and adjust the spacing between the forks, and the third jack is selectively actuatable to move the carrier and side shift the forks in unison. The carriage assembly is particularly suited for use on a lift mast.

8 Claims, 4 Drawing Sheets 26
36
40
20
50
60
43
84
66
85
30
48
70
72,74
44
80
58
101
110
100
96
32
104
134
120,124
132
54,56
94
122
92
132
134
66
88
86
102
64
116
70
118
52
98
114
42
50
90
43
62
38
66
70

CARRIAGE ASSEMBLY HAVING SIDE SHIFTABLE AND ADJUSTABLE FORKS

DESCRIPTION

1. Technical Field

This invention relates to a carriage assembly having side shiftable and adjustable forks and more particularly to a carriage assembly having three jacks and carrier for moving a pair of forks in unison for side shifting and independently for fork adjustment.

2. Background Art

Lift masts of the type used on material handling vehicles typically have a carriage mounted thereon and a pair of forks mounted on the carriage assembly. The carriage assembly is elevationally movable along the uprights and the forks are manually movable on the carriage frame transverse the uprights. The forks are movable on the carriage to facilitate the proper spacing therebetween so that the forks may be engaged with a load to be lifted. Usually, the fork spacing is determined by the dimensions between the pockets of a pallet, the sides of a tub, the width of a load or the like. Elevational movement of the carriage assembly along the uprights of the lift mast facilitates the raising and/or lowering of a load. An example of a lift mast of this type is disclosed in U.S. Pat. No. 4,124,104 to William T. Yarris et al., dated Nov. 7, 1978.

Lift masts of the type shown in the U.S. Pat. No. 4,124,104 are satisfactory for use in applications where the type of load being transported is consistent in size and the spacing between the forks requires infrequent adjustment. However, in applications where the fork spacing must be changed frequently due to differing sizes of loads, powered fork adjustment is desired. An example of a carriage assembly with powered fork adjustment is shown in U.S. Pat. No. 3,754,673 to Rudolph C. Barda et al., dated Aug. 28, 1973. In this patent a pair of hydraulic cylinders are provided for selectively and independently moving each fork so that the spacing between each fork may be adjusted from the operator's compartment without the operator exiting the vehicle and doing it manually. In addition powered fork adjustment is extremely desirable in large vehicle applications where the weight of each fork is several hundred pounds.

Often it is desirable to have a carriage assembly with the ability to side shift so that the forks may be aligned with the load to be transported. Typically, such a feature is desirable in applications in which vehicle maneuvering space and/or time is limited. An example of a material handling vehicle with a side shift carriage is shown in U.S. Pat. No. 3,819,078 to Francis J. Walsh, dated Jun. 25, 1974. The side shift carriage is supported on a carriage frame and the forks are mounted on the side shift carriage. A hydraulic cylinder moves the side shift frame and positions the side shift frame so that the forks may be aligned with the load. This is not to be confused with fork adjustment where the spacing of the forks changes. In side shifting, the spacing between the forks remains constant and there is no relative movement between the forks.

It has been known to provide the fork adjustment and side shifting features on a single lift mast. An example of such is shown in U.S. Pat. No. 4,392,773 to Richard J. Johnson, dated Jul. 12, 1983. This patent teaches a pair of hydraulic jacks for positioning the forks and a single jack for shifting the side shiftable frame. Because the side shiftable carriage is stacked upon the carriage frame the load moment center is moved away from the center of gravity of the vehicle. This reduces the load carrying capacity of the vehicle and limits productivity or requires a larger counterweight to compensate for the additional load moment. Further the additional cost required to add the side shiftable feature to the already expensive carriage reduces the number of users and thus reduces overall industry productivity.

It is therefore desirable to have both the side shift and fork adjust features without having the need to utilize an additional side shift carriage and without the need for adding expensive and complicated controls.

The present invention is directed to overcoming one or more of the problems as set forth above.

DISCLOSURE OF THE INVENTION

In one aspect of the present invention, a carriage assembly for a lift mast comprises a carriage frame having a first elongated guide and a front surface. First and second load engaging forks each having a rear surface are connected to the first elongated guide and moveable along the first elongated guide in directions transversely of the lift mast. A carrier disposed in an area between the rear surface of the forks and the surface of the carriage frame is movably connected to the carriage frame. A first jack is positioned in the area between the rear surface of the first fork and the surface of the carriage frame and connected to and between the first fork and the carrier. The first jack is extensibly movable and the first fork is movable along the first elongated guide in response to extensible movement of the first jack. A second jack is positioned in the area between the rear surface of the second fork and the surface of the carriage frame and connected to and between the second fork and the carrier. The second jack is extensibly movable and the second fork is movable along the first elongated guide in response to extensible movement of the second jack. A third jack is positioned in the area between the rear surface of the forks and the surface of the carriage frame and connected to and between the carrier and the carriage frame. The third jack is extensibly movable and the first and second forks are movable in unison along the first elongated guide in response to extensible movement of the third jack.

A lift mast having a pair of spaced apart uprights comprises a carriage frame having first and second elevationally spaced apart substantially parallel elongated guides, a surface, and a pair of spaced apart roller brackets connected to the first and second elongated guides and movably connected to the pair of spaced apart uprights. First and second load engaging forks each having a rear surface are connected to the elongated guides. The forks are each moveable along the elongated guides in directions transversely of the uprights. A carrier is disposed in an area between the rear surface of the forks and the surface of the carriage frame and between the first and second guides. A connecting device movably connects the carrier to the carriage frame. A first extensible jack is positioned in the area between the rear surface of the first fork and the surface of the carriage frame, between the first and second guides, and is connected to and between the first fork and the carrier. The first fork is movable along the first and second elongated guides in response to extensible movement of the first jack. A second extensible jack is positioned in an area between the rear surface of the second fork and the surface of the carriage frame, between the first and second guides, and is connected to and between the second fork and the carrier. The second fork is movable along the first and second elongated guides in response to extensible movement of the second jack. A third extensible jack is positioned in the area between the rear surface of the first and second forks and the surface of the carriage frame, between the first and second elongated guides, and is connected to and between the carrier and the carriage frame. The first and second forks are movable in unison along the first and second elongated guides in response to extensible movement of the third jack.

A material handling vehicle, having a frame and a lift mast pivotally connected to the frame is provided. The lift mast has pair of spaced apart uprights. A carriage frame has first and second elevationally spaced apart substantially parallel elongated guides, a surface, and a pair of spaced apart roller brackets connected to the first and second elongated guides and movably connected to the pair of spaced apart uprights. First and second load engaging forks having a rear surface are connected to the elongated guides. The forks are each moveable along the elongated guides in directions transversely of the uprights. A carrier is disposed in an area between the rear surface of the forks and the surface of the carriage frame and between the first and second guides. A means movably connects the carrier to the carriage frame. A first extensible jack is positioned in the area between the rear surface of the first fork and the surface of the carriage frame, between the first and second guides, and is connected to and between the first fork and the carrier. The first fork is movable along the first and second elongated guides in response to extensible movement of the first jack. A second extensible jack is positioned in the area between the rear surface of the second fork and the surface of the carriage frame, between the first and second guides, and is connected to and between the second fork and the carrier. The second fork is movable along the first and second elongated guides in response to extensible movement of the second jack. A third extensible jack is positioned in the area between the rear surface of the first and second forks and the surface of the carriage, between the first and second elongated guides, and is connected to and between the carrier and the carriage frame. The first and second forks are movable in unison along the first and second elongated guides in response to extensible movement of the third jack.

BEST MODE FOR CARRYING OUT THE INVENTION

Figure 1:
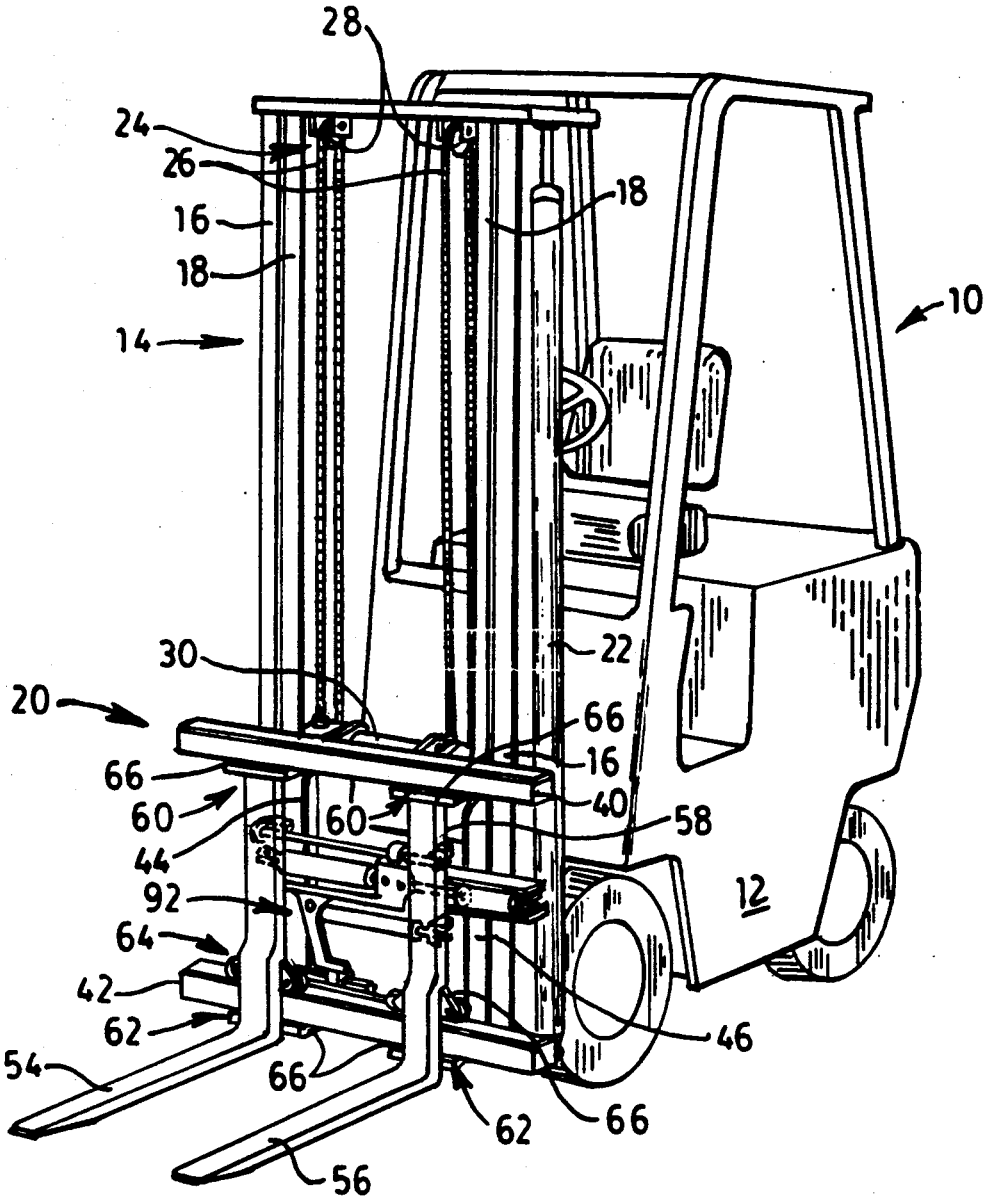
FIG. 1 is a diagrammatic isometric view of an embodiment of the present invention showing a material handling vehicle having a lift mast and a carriage assembly connected to the lift mast.

With reference to the drawings, and particularly FIG. 1, a material handling vehicle 10 is shown. The material handling vehicle 10 has a frame 12 and a lift mast 14 of the standard lift type pivotally connected to the frame in any suitable and conventional manner. The lift mast 14 has first and second pairs of spaced apart uprights 16,18 and a carriage assembly 20 connected to the uprights of the second pair 18 and elevationally movable therealong. The second pair of uprights 18 are guided by the first pair of uprights 16 and elevationally movable relative to the first pair of uprights 16 in an extensible manner The uprights 16,18 may be of any suitable typical configuration, channel, "I" or "J" in crossection. The second pair of uprights 16 are disposed between the first pair of uprights 18 and guided for movement along the first pair of uprights 16 by a plurality of rollers (not shown). Such construction is well known in the art and and will not be discussed in any greater detail.

A pair of spaced apart fluid operated lift jacks 22 (only one shown), connected between the first and second pair of uprights 16,18, is provided for elevationally moving the second uprights 16 along the first pair of uprights 18 under the influence of fluid pressure. A chain and sheave arrangement 24, of any suitable conventional design, is provided for elevationally moving the carriage assembly 22 along the second pair of uprights 18. The chain and sheave arrangement 24 preferably includes a pair of chains 26 connected at opposite ends thereof to the carriage assembly 22 and first pair of uprights 16, and pair sheaves 28 connected to the second pair of uprights 18 at a location between the second upright pair 18. The chains 26 are trained over a respective sheave 28 and propel the carriage assembly 20 along the second pair of uprights 18 in response to elevational movement of the second pair of uprights 18. The particular lift mast 14 heretofore discussed is for illustrative purposes only and may be replaced with other types of standard lift, free lift, full free lift, tipple lift and quad lift mast assemblies without departing from the invention.

Figure 2:
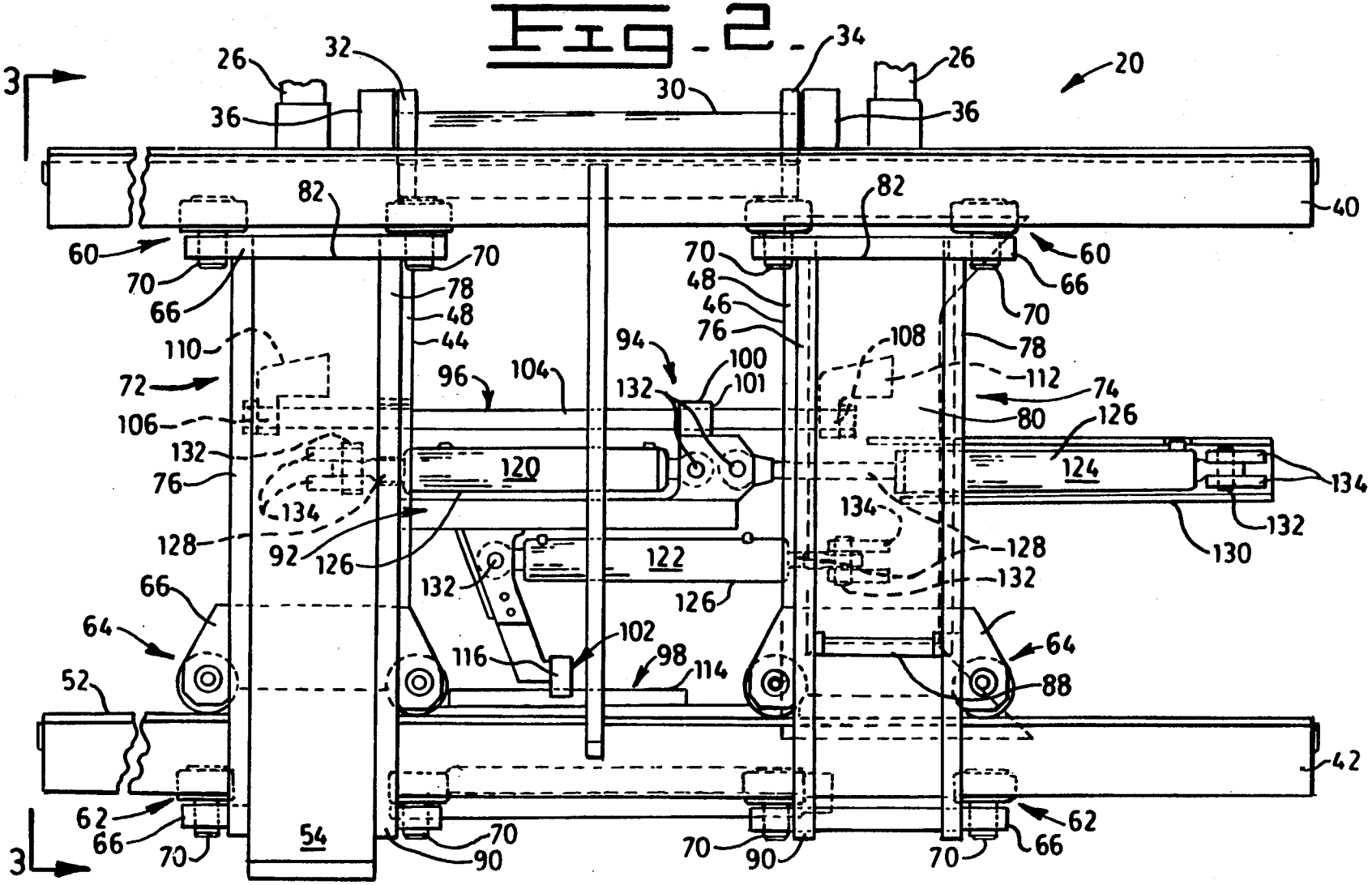
FIG. 2 is a diagrammatic front elevational view of another embodiment of the carriage assembly of the present invention with portions removed to show various components in greater detail.
Figure 3:
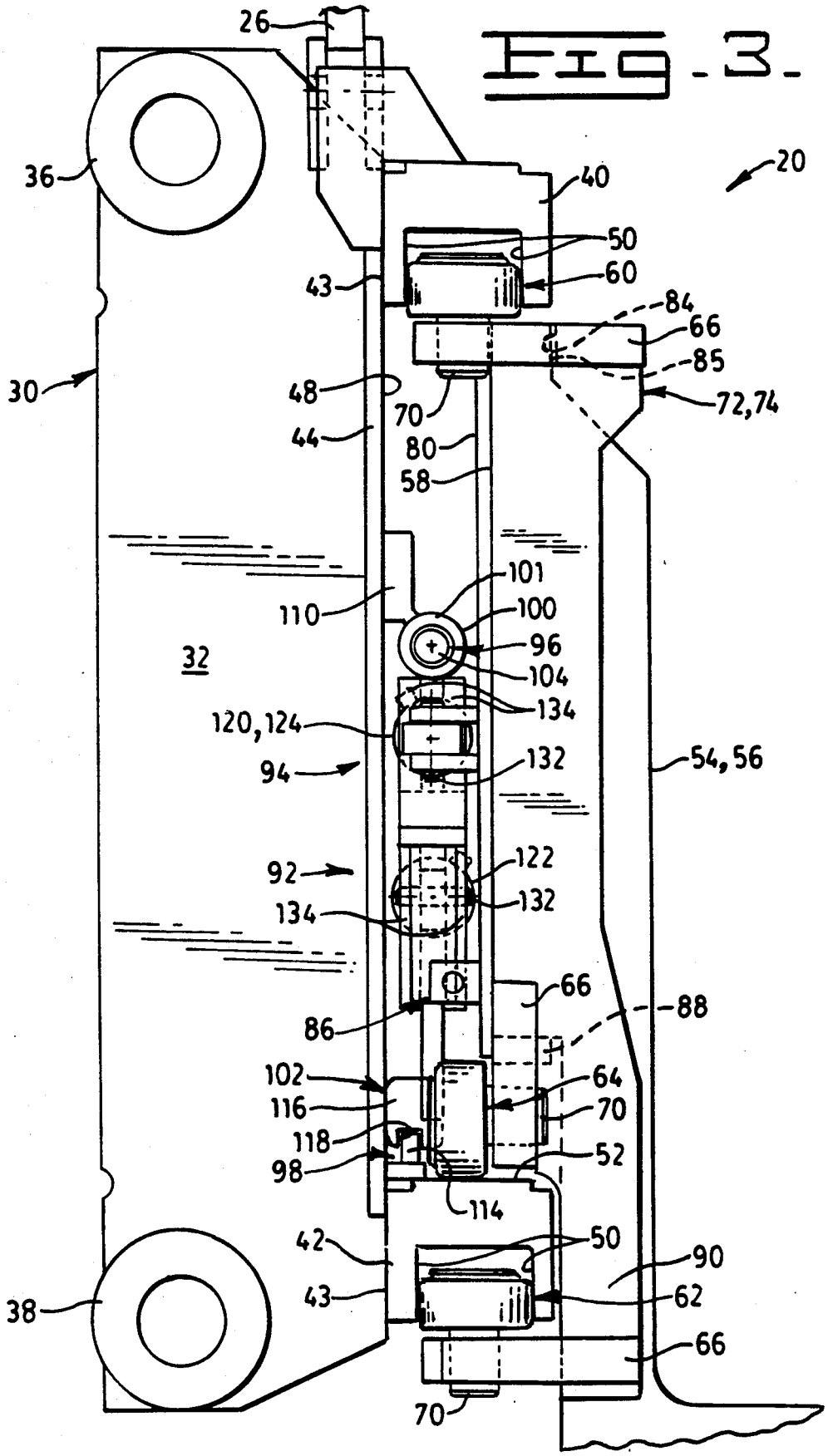
FIG. 3 is a diagrammatic side elevational view of the carriage assembly taken along lines 3—3; of FIG. 2.

As best seen in FIGS. 2 and 3, the carriage assembly 20 has a carriage frame 30 having first and second substantially parallel roller brackets 32,34 and a pair of rollers 36,38 connected to each of the roller brackets 32,34. The roller brackets 32,34 are disposed between the second pair of uprights 18 and the rollers 36,38 are engageable with the second upright pair 18. The rollers 36,38 guide the carriage assembly 20 for elevational movement along the second upright pair.

The carriage assembly 20 has first and second elevationally spaced apart elongated guides 40,42 which are connected at a first surface 43 of the elongated guides 40,42 to the first and second roller brackets 32,34 by welding or other suitable fastening techniques, and first and second spaced apart elongated flanges 44,46 which are oriented in an elevational direction and connected to the first and second elongated guides 40,42, for example, by welding. The first and second elongated guides 40,42 are channel shaped in transverse crossection and open in a downward depending direction relative to the elevational movement of the carriage assembly 20. The channels are defined by facing bearing surfaces 50. The second elongated guide 42 has an upper bearing surface 52 the function of which will all be subsequently discussed. The elongated flanges 44,46 serve to maintain the first and second elongated guides 40,42 and particularly the channels thereof substantially parallel to each other and define a surface 48 of the carriage frame 30 to which other components and elements may be attached. The two elongated flanges 44,46 are preferred since the weight of the carriage frame 20 is reduced, however, the two flanges 44,46 may be replaced with a single flange without departing from the invention.

Referring to FIG. 1, first and second load engaging forks 54,56 each having a rear surface 58 are movably connected to the first and second elongated guides 40,42 and movable along the guides 40,42 in directions transverse the upright pairs 16,18. The first and second forks 54,56 are each guided along the first and second elongated guides 40,42 by first, second, and third pairs of rollers 60,62,64. The first roller pairs 60 are disposed in the channel of the first elongated guide 40 and engageable with one of the bearing surfaces 50. The second roller pairs 62 are disposed in the channel of the second elongated guide 42 and engageable with one of the bearing surfaces 50. The third roller pairs 64 are engageable with the upper bearing surface 52. The third roller pairs 64 support the forks 54,56 in the vertical direction and maintaining the first and second roller pairs 60,62 in the channels 50 of the first and second elongate guides 40,42.

As seen in the embodiment of FIG. 1. the first, second, and third pairs of rollers 60,62,64 associated with each fork 54,56 are directly connected to the forks 54,56 by brackets 66. The rollers 60,62,64 are each rotatively mounted on a shaft 70 and the shafts 70 are connected to the brackets 66 in any suitable manner, for example, such as by welding, pinning and threading.

As shown in the embodiment of FIGS. 2 and 3, first and second fork pocket assemblies 72,74 are provided for connecting the first and second forks 54,56 to the first and second elongated guides 40,42 and guiding the forks for longitudinal movement along the guides 40,42. The fork pocket assemblies 72,74 each include first and second parallel sides 76,78 and a rear end portion 80 connected to the parallel sides 76,78. The first, second, and third roller pairs 60,62,64, which are of a similar construction to those discussed above, are connected by brackets 66 to the fork pocket assemblies 72,74. The bracket 66 located at an upper end 82 of the the fork pocket assemblies 72,74 has a notch 84 for receiving a reduced size upper end portion 85 of the forks 54,56 and retaining the upper end portion 82 of the forks 54,56 in the fork pocket. A latch assembly 86 of any suitable design, for example; a spring biased pull pin or the like, is provided for retaining the lower end portion 88 of the forks 54,56 in the fork pocket assemblies 72,74. A ledge 88 is provided in the pockets defined by the first and second sides 76,78 to support the vertical load carried on the forks 54,56. The second roller pairs 62 are connected to a lower end portion 90 of each of the fork pocket assemblies 72,74 and extend to engage the channel in the second elongated guide 42. The third roller pairs 64 are connected to each of the first and second fork pocket assemblies 72,74 at a location between the first and second roller pairs 60,62. The shaft 70 of the first and second roller pairs of FIGS. 1, 2 and 3, extend axially in a vertical direction, and the shaft 70 of the third roller pairs 64 extend in a substantially horizontal direction. The first and second roller pairs 60,62 resist the moment created by a load on the forks 54,56 and the third roller pairs resists the vertical load on the forks 54,56. It is to be noted that the first and second forks 54,56 may be optionally connected and guided for slidable sideways movement in other ways along the carriage frame 30, for example conventional hook or shaft type fork mountings. Such mounting techniques are well known in the art and within the spirit of the invention.

A carrier 92 which is disposed between the surface 48 of flanges 44,46 and the rear surface of the forks 54,56 and between the first and second elongated guides 40,42 is provided to facilitate individual fork adjustment and fork side shift in unison along the first and second elongated guides 40,42. Means 94 is provided for movably connecting the carrier 92 to the carriage frame 30 and guiding the carrier 92 for movement in the transverse directions of movement of the forks 54,56 (the direction of orientation of the elongated guides). The connecting means 94 includes first and second elevationally spaced apart substantially parallel rails 96,98, and first and second slide members 100,102 slidably connecting the carrier 92 to the first rail 96 and the carrier 98 to the second rail 98. The first rail 96 is preferably includes a cylindrical rod 104 having first and second spaced apart end portions 106,108 and first and second brackets 110,112 connecting the first and second end portions 106,108 to the first and second elongated flanges 44,46. The brackets 110,112 are attached to the flanges 44,46 in any suitable manner, such as by welding or by threaded fasteners. The second rail 98 includes an elongated rectangular shaped rod 114 connected to the first and second elongated flanges 44,46 in any suitable manner. The first slide member 100 preferably includes a tubular sleeve 101 slidably disposed about the rod 104 and the second slide member 102 includes a block 116 having a notch 118. The rectangular rod 114 is disposed in the notch 118. The first slide member 100 is connected to an upper end portion of the carrier 92 which is preferably plate material and the second slide member 102 is connected to a lower end portion of the carrier 92 opposite the first slide member 102. The first and second rails 96,98 and the first and second slide members are disposed in the area between the surface 48 of the carriage frame 30 and the rear surface 58 of the forks 54,56. Thus, the carrier is positioned in the area between the first and second rails 96,98 and the between the surface 48 and the rear surface 58.

First, second, and third jacks 120,122,124 are positioned in the area between the rear surface 58 of the forks 54,56, the surface 48 of flanges 44,46 and the first and second rails 96,98. The first jack 120 is connected to and between the first fork 54 and carrier 92 and extensibly movable to move the first fork 54 relative to the carrier 92 and along the first and second elongated guides 40,42. The second jack 122 is connected to and between the second fork 56 and carrier 92 and extensibly movable for moving the second fork 56 relative to the carrier 92 along the first and second elongated guides 40,42. The third jack 124 is connected to and between the the carrier 92 and the second flange 46 of the carriage frame 30 and extensibly movable for moving the carrier 92 along the first and second rails 96,98 and the first and second forks 54,56 along the first and second elongated guides 40,42. Movement of the forks 54,56 in unison along the first and second guides 42,40 is achieved by the connection of the first and second jacks 120,122 to the carrier and the first and second forks 54,56, respectively. With the first and second jacks 120,122 locked from extensible movement, extension of the third jack 124 and movement of the carrier 92 causes the side shift action of the forks 54,56.

The first, second, and third jacks 120,122,124 are preferably, but not limited to, hydraulic jacks each having a cylinder 126 and a rod 128 slidably connected to the cylinder 126. The rods 128 of the first and second jacks 120,122 are pivotally connected to the first and second forks 54,56, respectively, and the cylinders 126 of the first and second jacks 120,122 are pivotally connected to the carrier 92. The rod 128 of the third jack 124 is pivotally connected to the carrier 92 and the cylinder of the third jack is pivotally connected to the second flange 46 of the carriage frame 30. An elongated rectangular two sided channel shaped housing 130, intermediate the second flange 46 and the cylinder 126 of the third jack 124, connects the third jack cylinder 126 to the surface 48. The channel shaped housing 130 is rigidly connected to the surface 48 by welding or any other suitable fastening technique and pivotally connected to the cylinder 128 of the third jack 124. The rods 128 and cylinders 126 each have an eye portion which is pivotally connected to the aforementioned components by a pivot pins 132 and a bifurcated flange portion 134. It is to be noted that in the embodiment of FIG. 1 the jacks are directly pivotally connected to the forks 54,56 and in the embodiment of FIGS. 2 and 3 the jacks are directly pivotally connected to the fork pocket assemblies 72,74.

Figure 4:
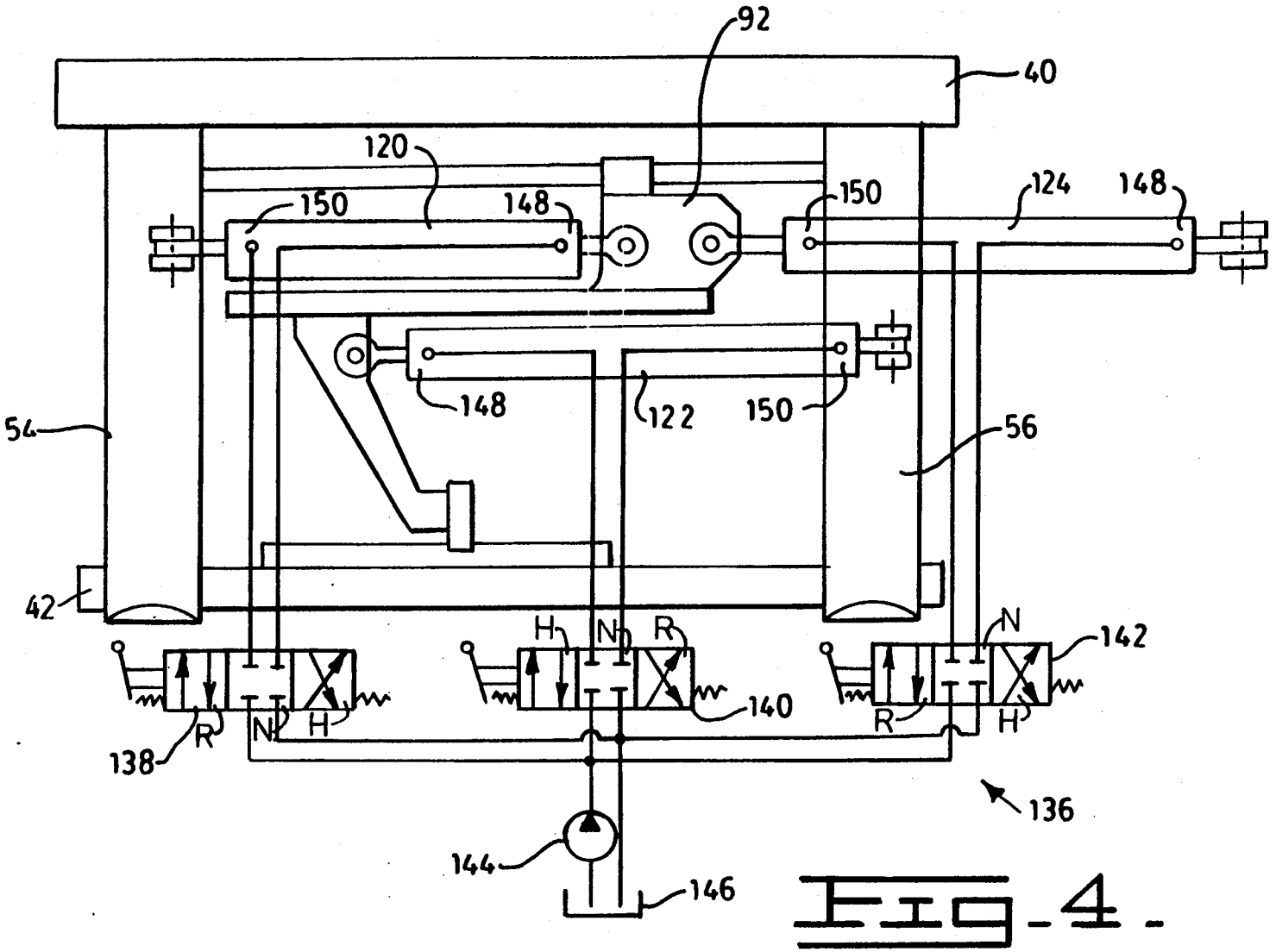
FIG. 4 is a diagrammatic schematic view of a hydraulic system for controlling operation of carriage side shift and fork adjustment.

Referring to FIG. 4, a hydraulic schematic diagram of a control system 136 for controlling fork movement is shown. It is to be mentioned that mechanical and electrical equivalents may be substituted for the hydraulic components without departing from the spirit of the invention. The control system 136 includes first, second and third 138,140,142 manually actuatable three position, four way control valves which are connected to and between their respective first, second and third jacks 120,122,124, and a source of pressurized fluid flow 144, for example, a pump, and a reservoir 146. The control valves 138,140,142 each have a neutral position "N" at which fluid flow from the source 144 to the respective jack 120,122,124 is blocked, fluid flow from the respective jack 120,122,124 to the reservoir 146 is blocked, and fluid flow from the jacks 120,122,124 is blocked at the respective control valve 138,140,142 and the jacks are hydraulically locked so that extensible movement is prevented. The control valves 138,140,142 are each shiftable from the neutral position "N" to a first position "H" at which fluid flow is deliverable from the source 144 to a head end 148 of the respective jack 120,122,124, and from a rod end 150 of the respective jack 120,122,124 to the reservoir 146. The control valves 138,140,142 are also each shiftable from the neutral position "N" to a second position "R" at which fluid flow is deliverable from the source 144 to the rod end 150 of the respective jack 120,122,124, and from a head end 148 of the respective jack 120,122,124 to the reservoir 146. As viewed in FIG. 4, fluid delivered from the source 144 to the head end 148 of the jacks 120,122,124 will cause extension of the rods 128 of the jacks 120,122,124 and fluid delivered to the rod end 150 of the jacks 120,122,124 will cause retraction of the rods 128. Extension of the rod 128 of the first jack 120 will shift the first fork 54 to the left, extension of the rod 128 of the second jack 122 will shift the second fork 56 to the right and extension of the third jack 124 will shift the carrier 92 to the left. With the first and second control valves 138,140 in neutral, side shift of the first and second forks (equal speed and same direction of movement of the forks 54,56) is achieved by simply shifting the third control valve to the "R" or "H" position. This is achieved because fluid flow from the first and second jacks 120,122 is blocked at the valves 138,140 and the first and second jacks are hydraulically locked.

Although the control valves 138,140,142 of the control system 136 are preferably manually actuatable it would be appropriate to use a combination of electrohydraulic and manual control valves to achieve equivalent results. Given the invention disclosed herein it would be a relatively easy substitution to those skilled in the art. For example, the first, second and third control valves 138,140,142 could be replaced with first, second, and third two position, four way, solenoid operated control valves. The solenoid operated control valves would select the desired jack(s) to be actuated by actuating an appropriate electrical switch and a separate manually or pilot operated control valve would be provided to select the appropriate direction of hydraulic fluid flow to the head or rod ends of the selected jack and deliver fluid flow to the solenoid operated control valves.

INDUSTRIAL APPLICABILITY

With reference to the drawings, the carriage assembly 20 of the subject invention provides fork adjustment (independent movement of each fork 54,56) and side shift (movement of the forks transversely of t he uprights 16,18 without changing fork spacing) capabilities without sacrificing load carrying capacity, maneuverability of the vehicle, or controllability of the fork adjustment and side shifting functions. Further, simplicity of design of carriage assembly 20 eliminates expensive and complicated structure and controls which tend to wear prematurely or otherwise fail at the most inconvenient times.

The first and second forks 54,56 of the carriage assembly 20 are independently controllably movable by simply directing pressurized fluid flow via one of the first and second control valves to the desired end (head or rod ends 148,150) of the desired one(s) of the first and second jacks 120,122. The actuated jack(s) will cause the associated fork(s) to move along the elongated guides 40,42 in the selected direction and speed. By control system 136, the vehicle operator is able to easily change the spacing of the forks 54,56 anytime desired from the operators station on the vehicle 10 so that the forks 54,56 are spaced properly to permit engagement with the load to be lifted. Since the carrier 92 is restrained from slidable transverse movement when the third control valve 142 is in the neutral position "N" and the third jack 124 is hydraulically locked, extension of the first and/or second jacks will cause the forks 54,56 to move and not the carrier 92.

To side shift the forks 54,56 in unison (at the same speed and direction) the vehicle operator simply solely actuates the third control valve 142 to the desired position "R" or "H" associated with the desired direction of jack 54,56 movement. Because fluid in the head and rod ends 148,150 of the first and second jacks 120,122 is blocked at the first and second control valves 138,140, and the first and second jacks 120,122 are hydraulically locked, transverse movement of the carrier 92 caused by extension or retraction of the rod 128 of the third jack 124 will cause the first and second jacks to move with the carrier 92 and move the first and second forks 54,56 in the side shift mode.

Due to the fact that the carrier 92, the first, second and third jacks 120,122,124, and the connecting means 94 are positioned in an available space between the surface 48 and the rear surface 58 of the forks 54,56 (or the rear end portion 80 of the fork pocket assembly 72,74), and the longitudinal distance from the center of gravity of the vehicle 10 to the first and second forks 54,56 is unchanged, the load moment of the vehicle 10 remains unchanged. This results in the vehicle being able to operate at maximum load carrying capacity and retains maximum maneuverability.

Connecting of the forks 54,56 by means of the first, second and third roller pairs 60,62,64 to the first and second elongated guides 40,42 reduces the potential for undesirable cocking, twisting, tipping and the like and guides the forks for smooth low effort movement in the transverse directions. The reduced effort in moving the forks 54,56 in the transverse directions diminishes the amount of energy required to cause movement. Thus, the efficiency of the control system 136 is improved. Since the source 144 of pressurized fluid flow is driven by an engine, motor or the like less fuel or electricity Will be consumed. Further, the roller pairs 60,62,64 and construction thereof are more durable than other typical fork mounting arrangements and thus premature failure is essentially eliminated. The fork pocket assemblies 72,74 are particularly useful in applications where the forks 54,56 are large, heavy, and difficult to attach to the vehicle carriage assembly.

Other aspects, objects and advantages of the present invention can be obtained from a study of the drawings, the disclosure and the appended claims.

I claim:

1. A carriage assembly for a lift mast, comprising:

a carriage frame having a first elongated guide and a flange defining a front surface;

first and second load engaging forks each having a rear surface and being connected to the first elongated guide, said forks each being moveable along the first elongated guide in directions transversely of the lift mast;

a carrier disposed in an area between the rear surface of the forks and the surface of the carriage frame and being movably connected to the carriage frame;

means for movably connecting said carrier to said carriage frame and guiding said carrier for movement in said transverse directions, said connecting means including first and second rails connected to the carriage frame at elevationally spaced apart locations, said first and second rails being substantially parallel to each other and to the first elongated guide, and first and second slide members connected to the carrier and slidably engaged with the first and second rails, said first rail including a cylindrical rod having first and second spaced apart end portions and first and second brackets connected to said cylindrical rod at said first and second rod end portions and to said flange, said second rail including an elongated rectangular shaped rod connected to the flange, said first slide member including a tubular sleeve disposed about the cylindrical rod, and said second slide member including a block having a notch disposed therein, said second rail being disposed in the notch;

a first jack being positioned in the area between the rear surface of the forks and the surface of the carriage frame and being connected to and between the first fork and the carrier, said first jack being extensibly movable and said first fork being movable along said first elongated guide in response to extensible movement of said first jack;

a second jack being positioned in the area between the rear surface of the forks and the surface of the carriage frame and being connected to and between the second fork and the carrier, said second jack being extensibly movable and said second fork being movable along said first elongated guide in response to extensible movement of said second jack;

a third jack being positioned in the area between the rear surface of the forks and the surface of the carriage frame and being connected to and between the carrier and the carriage frame, said third jack being extensibly movable and said first and second forks being shiftable in unison along said first elongated guide in response to extensible movement of said third jack.

2. A carriage assembly as set forth in claim 1, wherein said first, second and third jacks are hydraulic jacks, said jacks each having a rod and a cylinder and each being pivotally connected at one of the rod and cylinders to the carrier, the other of the rod and cylinder of the first and second jacks being pivotally connected to the first and second forks and the other of the rod and cylinder of the third jack being pivotally connected to the carriage frame.

3. A carriage assembly as set forth in claim 2, including:

a source of pressurized fluid flow ;

a reservoir;

a first control valve connected between the first jack and the fluid source and reservoir, said first control valve having a neutral position at which fluid communication between the first jack and reservoir, and between the first jack and pump is blocked and said first jack is hydraulically locked;

a second control valve connected between the second jack and the fluid source and reservoir, said second control valve having a neutral position ("N") at which fluid communication between the second jack and reservoir and between the second jack and pump is blocked and said second jack is hydraulically locked;

a third control valve connected between the third jack and the fluid source and reservoir, said third control valve being selectively shiftable between a neutral position ("N") at which fluid communication between the third jack and reservoir and between the third jack and fluid source is blocked, and another position ("R","H") at which fluid flow is directed from the fluid source to the third jack, said first and second forks moving in unison in response to said third control valve being at the another position ("R","H") and at the neutral position ("N") of the first and second control valves.

4. A carriage assembly as set forth in claim 3, wherein said first and second control valves are each independently shiftable from the neutral position ("N") to at least one other position ("R","H"), said first and second control valves respectively delivering fluid flow from the fluid source to the first and second jacks and exhausted fluid flow from the first and second jacks to the reservoir at the one other position ("R","H"), said spacing between the first and second forks being adjustable relative to each other in response to either or both of the first and second control valves being at the one other position ("R","H").

5. A carriage assembly as set forth in claim 1, including a second elongated guide connected to said carriage frame, spaced from said first elongated guide, and substantially parallel to said first elongated guide, said first and second forks being movably connected to the first and second elongated guides and guided therealong for movement in said transverse directions.

6. A carriage assembly as set forth in claim 5, wherein said first and second elongated guides each have a channel, said carriage assembly including first and second fork pocket assemblies each having first and second pairs of rollers, said first and second forks being connected to the first and second fork pocket assemblies and said first and second pairs of rollers being disposed in the channels of the first and second elongated guides, said channels and roller pairs guiding said forks for said transverse movement.

7. A carriage assembly as set forth in claim 6, wherein said first and second fork pocket assemblies each have a third pair of rollers and said second elongated guide has an upper bearing surface, said third roller pairs being engageable with the upper bearing surface, supporting said forks in the vertical direction, and maintaining the first and second roller pairs in the channels of the first and second elongate guides.

8. A lift mast having a pair of spaced apart uprights comprising:

a carriage frame having first and second elevationally spaced apart substantially parallel elongated guides, a flange defining a surface, and a pair of spaced apart roller brackets connected to the first and second elongated guides and movably connected to the pair of spaced apart uprights;

first and second load engaging forks each having a rear surface and being connected to the elongated guides, said forks each being moveable along the elongated guides in directions transversely of the pair of uprights;

a carrier being disposed in an area between the rear surface of the forks and the surface of the carriage frame, and between the first and second elongated guides;

means for movably connecting said carrier to said carriage frame, said connecting means including first and second rails connected to the carriage frame at elevationally spaced apart locations, said first and second rails being substantially parallel to each other and to the first elongated guide, and first and second slide members connected to the carrier and slidably engaged with the first and second rails, said first rail including a cylindrical rod having first and second spaced apart end portions and first and second brackets connecting said rod first and second rod end portions, respectively, to said flange, said second rail including an elongated rectangular shaped rod connected to the flange, said first slide member including a tubular sleeve disposed about the first rod, said second slide member including a block having a notch disposed therein, said second rail being disposed in the notch;

a first extensible jack being positioned in the area between the rear surface of the first fork and the surface of the carriage frame, between the first and second elongated guides, and being connected to and between the first fork and the carrier, said first fork being movable along said first and second elongated guides in response to extensible movement of said first jack;

a second extensible jack being positioned in the area between the rear surface of the second fork and the surface of the carriage frame, between the first and second elongated guides, and being connected to and between the second fork and the carrier, said second fork being movable along said first and second elongated guides in response to extensible movement of said second jack;

a third extensible jack being positioned in the area between the rear surface of the first and second forks and the surface of the carriage frame, between the first and second elongated guides, and being connected to and between the carrier and the carriage frame, said first and second forks being movable in unison along said first and second elongated guides in response to extensible movement of said third jack.

* * * * *